US009624081B1

(12) United States Patent
Gloster

(10) Patent No.: US 9,624,081 B1
(45) Date of Patent: Apr. 18, 2017

(54) ARTICLE ELEVATION APPARATUS

(71) Applicant: MASSACHUSETTS MUTUAL LIFE INSURANCE COMPANY, Springfield, MA (US)

(72) Inventor: Christopher J. Gloster, Agawam, MA (US)

(73) Assignee: Massachusetts Mutual Life Insurance Company, Springfield, MA (US)

( * ) Notice: Subject to any disclaimer, the term of this patent is extended or adjusted under 35 U.S.C. 154(b) by 0 days.

(21) Appl. No.: 14/825,686

(22) Filed: Aug. 13, 2015

(51) Int. Cl.
*B66F 3/00* (2006.01)
*B66F 15/00* (2006.01)

(52) U.S. Cl.
CPC ..... *B66F 15/00* (2013.01)

(58) Field of Classification Search
CPC ..... B66F 7/18; B66F 19/005; B66F 2700/09; B66F 15/00
USPC ..... 254/131, 131.5, 129, 133 R, 106, 120
See application file for complete search history.

(56) References Cited

U.S. PATENT DOCUMENTS 4,738,433 A * 4/1988 Hoff ..... E04H 17/265 254/30
5,022,632 A * 6/1991 Beideck ..... B25B 27/02 254/132
5,261,643 A * 11/1993 Wurdack ..... B66F 1/02 254/106
5,490,757 A * 2/1996 Stratman ..... B66F 15/00 254/131
5,529,287 A * 6/1996 Pelosi, Jr. ..... B66F 15/00 254/129
5,628,610 A * 5/1997 Stratman ..... B66F 15/00 254/131
5,833,215 A * 11/1998 Vandenburg ..... E04H 17/265 254/30
2014/0117295 A1* 5/2014 Shaw ..... E04H 17/265 254/30
2015/0217980 A1* 8/2015 Beal ..... B66F 1/06 49/506

* cited by examiner

*Primary Examiner* — Larry E Waggle, Jr.
*Assistant Examiner* — Nirvana Deonauth
(74) *Attorney, Agent, or Firm* — Eric L. Sophir; Dentons US LLP

(57) ABSTRACT

In one embodiment of the present disclosure, an apparatus is described for use in lifting an article. The apparatus includes a support arm, a lever arm that is movably connected to the support arm, and a headpiece supported by the lever arm that is configured and dimensioned to engage the article such that a force applied to the lever arm is transmitted to the article to thereby lift the article. In another embodiment of the present disclosure, a kit is described for use in lifting an article. The kit includes a support arm, a lever arm that is movably connected to the support arm, a first headpiece supportable by the lever arm having a first configuration facilitating engagement with the article, and a second headpiece supportable by the lever arm having a second configuration facilitating engagement with the article different than the first configuration.

18 Claims, 10 Drawing Sheets

ARTICLE ELEVATION APPARATUS

FIELD OF THE INVENTION

The present disclosure describes various systems, apparatus, kits, and methods that relate generally to the movement and relocation of articles, e.g., office furniture.

BACKGROUND

It is often necessary to raise, lift, and/or move articles, such as, for example, to clean or replace the flooring beneath the articles. Lifting and/or moving articles, however, can often be difficult or dangerous due to the weight, size, or awkward configuration of the articles. While various types of apparatus have been developed to assist in such endeavors, known apparatuses can be costly to manufacture, heavy, and/or complex to maneuver and operate due to the inclusion of pneumatics, ratcheting structures, or the like. Additionally, it is not uncommon for such apparatuses to result in damage to the article, or to require partial disassembly of the article prior to use.

Accordingly, there remains a need for systems, apparatus, and methods that provide the mechanical advantages of known apparatuses, but overcome the limitations of the current technology.

SUMMARY

In one aspect of the present disclosure, an apparatus is described for use in lifting an article. The apparatus includes a support arm, a lever arm that is connected to the support arm such that the lever arm is movable in relation to the support arm, and a headpiece supported by the lever arm that is configured and dimensioned to engage the article such that a force applied to the lever arm is transmitted to the article to thereby lift the article.

In certain embodiments, the headpiece may include a body, and a male engagement portion extending outwardly from the body that is configured and dimensioned for engagement with a female engagement portion of the article.

In certain embodiments, the male engagement portion may include one or more projections that are configured and dimensioned for positioning within one or more recesses defined by the female engagement portion of the article.

In certain embodiments, the projection(s) may include a first portion extending outwardly from the body of the headpiece along a first axis, and a second portion extending outwardly from the first portion along a second axis transverse in relation to the first axis. In such embodiments, the body of the headpiece and second portion of the at least one projection may define a gap therebetween that is configured and dimensioned to receive a portion of the article.

In certain embodiments, the projection(s) may be configured and dimensioned such that the first and second axes subtend an angle of 90°. Alternatively, the first and second axes may subtend an angle that is less than or greater than 90°.

In certain embodiments, the lever arm may be pivotably connected to the support arm at a first pivot point.

In certain embodiments, the first pivot point and a first end of the lever arm may define a first distance therebetween, and the first pivot point and a second, opposite end of the lever arm may define a second distance therebetween less than the first distance. For example, the first distance may be 25%-75% of an overall length of the lever arm.

In certain embodiments, the lever arm may be pivotably connected to the headpiece at a second pivot point.

In certain embodiments, the first and second pivot points may be in axial alignment.

In certain embodiments, the apparatus may further include a footing connected to the support arm.

In certain embodiments, the footing may include a body, and a surface interface secured to the body. In certain embodiments, the body of the footing may include, e.g., be formed from, a first material having a first durometer, e.g., metal or wood, and the surface interface may include, e.g., be formed from, a second material having a second durometer lower than the first durometer, e.g., rubber or a polymeric material.

In certain embodiments, the headpiece may be generally L-shaped in configuration. For example, the headpiece may include a first leg connected to the lever arm and extending along a first axis, and a second leg connected to and extending from the first leg along a second axis transverse in relation to the first axis.

In certain embodiments, the first and second axes may subtend an angle of approximately 90°.

In certain embodiments, the second leg may include a plurality of discrete fingers.

In certain embodiments, the second leg may include a beveled edge to facilitate positioning of the second leg beneath the article.

In certain embodiments, the first leg may define a first length, and the second leg may define a second length less than the first length.

In another aspect of the present disclosure, a kit is disclosed for use in lifting an article. The kit includes a support arm, a lever arm that is connectable to the support arm such that the lever arm is movable in relation to the support arm, a first headpiece supportable by the lever arm that has a first configuration facilitating engagement with the article, and a second headpiece supportable by the lever arm that has a second configuration facilitating engagement with the article that is different than the first configuration.

In certain embodiments, the first headpiece may include a male engagement portion having a first configuration facilitating engagement with a female engagement portion of the article, and the second headpiece may include a male engagement portion having a second configuration facilitating engagement with the female engagement portion of the article that is different than the first configuration.

In certain embodiments, the male engagement portion of the first headpiece may include a body, and one or more projections extending outwardly from the body that is configured and dimensioned for positioning within at least one recess defined by the female engagement portion of the article.

In certain embodiments, the projection(s) may include a first portion extending outwardly from the body of the first headpiece along a first axis, and a second portion extending outwardly from the first portion along a second axis transverse in relation to the first axis. In such embodiments, the body of the first headpiece and the second portion of the at least one projection may define a gap therebetween that is configured and dimensioned to receive a portion of the article.

In certain embodiments, the projection(s) may be configured and dimensioned such that the first and second axes subtend an angle of 90°. Alternatively, the first and second axes may subtend an angle that is less than 90° or greater than 90°.

In certain embodiments, the lever arm may be pivotably connectable to the support arm at a first pivot point.

In certain embodiments, the first pivot point and a first end of the lever arm may define a first distance therebetween, and the first pivot point and a second, opposite end of the lever arm may define a second distance therebetween less than the first distance. For example, the first distance may be 25%-75% of an overall length of the lever arm.

In certain embodiments, the lever arm may be pivotably connected to the headpiece at a second pivot point.

In certain embodiments, the first and second pivot points may be in axial alignment.

In certain embodiments, the support arm may include a footing.

In certain embodiments, the footing may include a body, and a surface interface that is secured to the body.

In certain embodiments, the body of the footing may include a first material having a first durometer, and the surface interface may include a second material having a second durometer lower than the first durometer.

In certain embodiments, the second headpiece may be generally L-shaped in configuration. For example, the second headpiece may include a first leg connectable to the lever arm and extending along a first axis, and a second leg connected to and extending from the first leg along a second axis transverse in relation to the first axis.

In certain embodiments, the first and second axes may subtend an angle of approximately 90°.

In certain embodiments, the second leg may include a plurality of discrete fingers.

In certain embodiments, the second leg may include a beveled edge to facilitate positioning of the second leg beneath the article.

In certain embodiments, the first leg may define a first length, and the second leg may define a second length less than the first length.

In another aspect of the present disclosure, a method of lifting an article is disclosed that includes stabilizing a support arm of an apparatus on a surface, and applying a force to a lever arm of the apparatus that is movably connected to the support arm such that the force is transmitted to a headpiece supported by the lever arm in engagement with the article to thereby lift the article.

In certain embodiments, the method may further include engaging the headpiece with the article.

In certain embodiments, engaging the headpiece with the article may include engaging a male engagement portion of the headpiece with a female engagement portion of the article.

In certain embodiments, engaging the male engagement portion of the headpiece with the female engagement portion of the article may include positioning at least one projection of the male engagement portion within at least one recess defined by the female engagement portion of the article.

In certain embodiments, positioning the at least one projection within the at least one recess may include positioning a plurality of projections within a plurality of recesses.

In certain embodiments, positioning the at least one projection within the at least one recess may include positioning the at least one projection such that a first portion of the projection extending outwardly from a body of the headpiece extends at least partially into the at least one recess, and a second portion of the projection extending outwardly from the first portion is positioned entirely within the at least one recess.

In certain embodiments, positioning the at least one projection within the at least one recess may include positioning the at least one projection such that a gap defined between the body of the headpiece and the second portion of the projection receives a portion of the article.

In certain embodiments, applying the force to the lever arm may include pivoting the lever arm in relation to the support arm at a first pivot point.

In certain embodiments, applying the force to the lever arm may include pivoting the headpiece in relation to the lever arm about a second pivot point.

In certain embodiments, pivoting the headpiece may include pivoting the headpiece with the first and second pivot points in axial alignment.

In certain embodiments, stabilizing the support arm may include stabilizing a footing connected to the support arm with respect to the surface.

In certain embodiments, stabilizing the footing may include positioning a surface interface secured to a body of the footing in contact with the surface.

In certain embodiments, applying the force to the lever arm may include compressing the surface interface against the surface.

In certain embodiments, engaging the headpiece with the article may include positioning first and second legs of the headpiece in relation to the article such that the second leg of the headpiece is beneath the article, wherein the first leg extends along a first axis, and the second leg is connected to and extends from the first leg along a second axis transverse in relation to the first axis, e.g., such that the first and second axes subtend an angle of approximately 90°.

In certain embodiments, positioning the second leg of the headpiece beneath the article may include positioning a plurality of discrete fingers of the second leg beneath the article.

In certain embodiments, positioning the second leg of the headpiece beneath the article may include positioning a beveled edge of the second leg beneath the article.

Other objects, features, and advantages of the present disclosure will become apparent with reference to the drawings and detailed description of the illustrative embodiments that follow.

DETAILED DESCRIPTION

In the following detailed description, reference is made to the accompanying drawings, which depict non-limiting, illustrative embodiments of the present disclosure. Other embodiments may be utilized and logical variations, e.g., structural and/or mechanical, may be implemented without departing from the scope of the present disclosure. To avoid unnecessary detail, certain information, items, or details known to those skilled in the art may be omitted from the following description.

The present disclosure relates to apparatuses and methods for lifting and moving articles that provide a number of benefits over those which are known in the art. For example, the apparatuses described herein are inexpensive to manufacture and simple to use in comparison to known apparatuses, thereby resulting in an overall reduction in the time required for assembly and setup. Additionally, the apparatuses described herein are not only lightweight and portable, but provide for a direct interface with an article, curtail the potential for damage to the article, and reduce, if not completely obviate, the need to disassemble the article.

Figure 1:
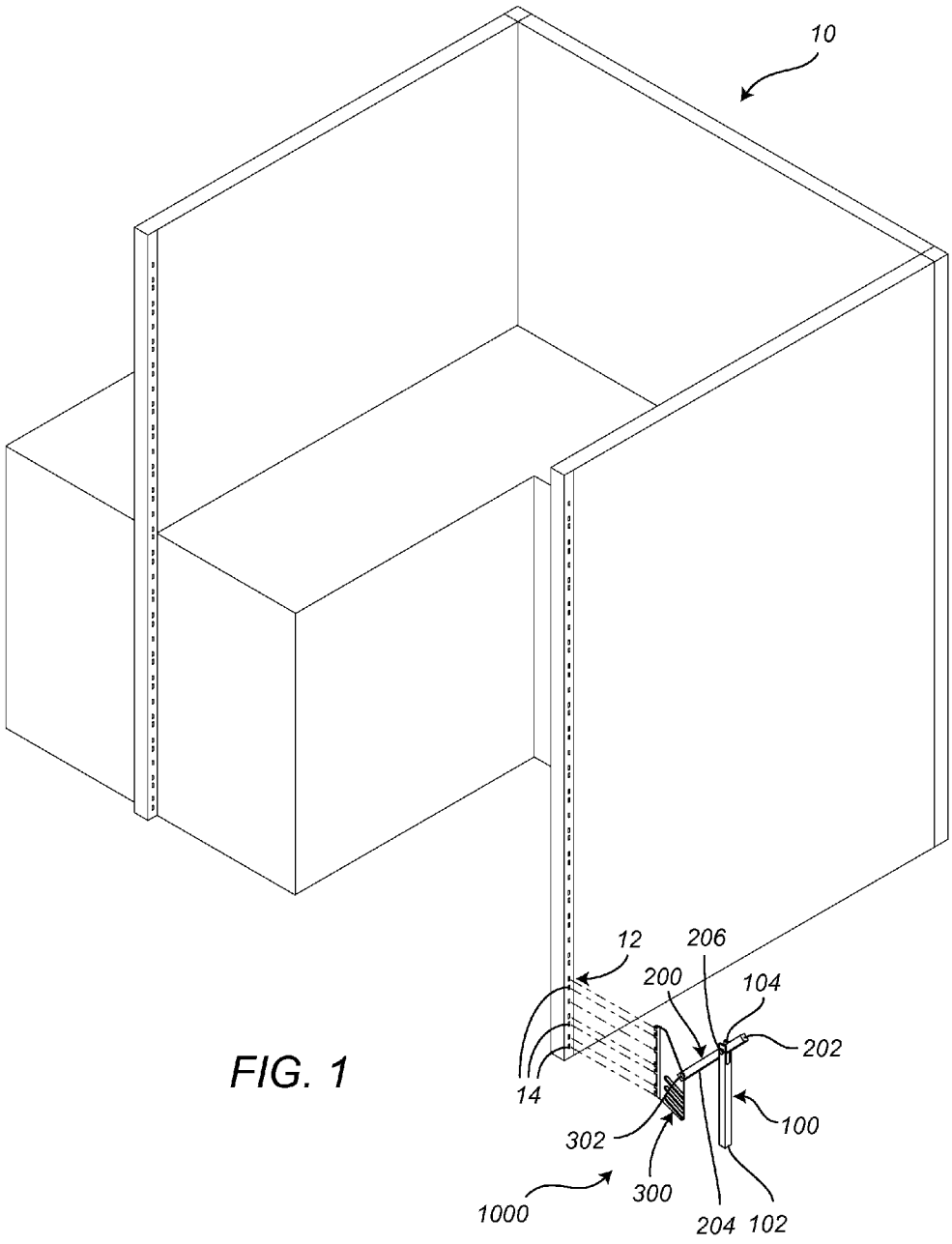
FIG. 1 is a perspective view illustrating an article, e.g., office furniture, together with one embodiment of an apparatus for elevating the article according to the principles of the present disclosure.
Figure 2:
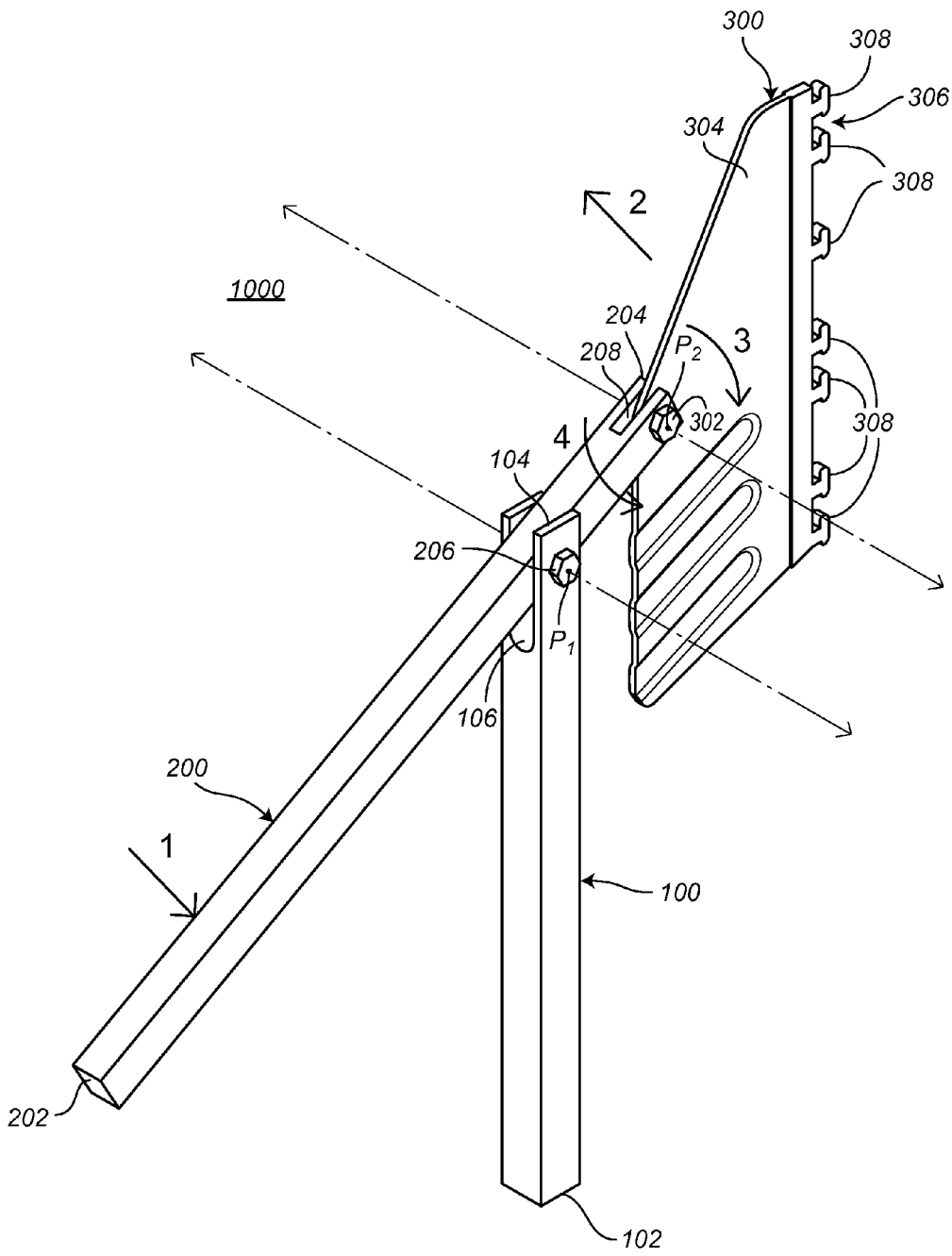
FIG. 2 is a side, perspective view of the apparatus seen in FIG. 1, according to an exemplary embodiment.
Figure 3:
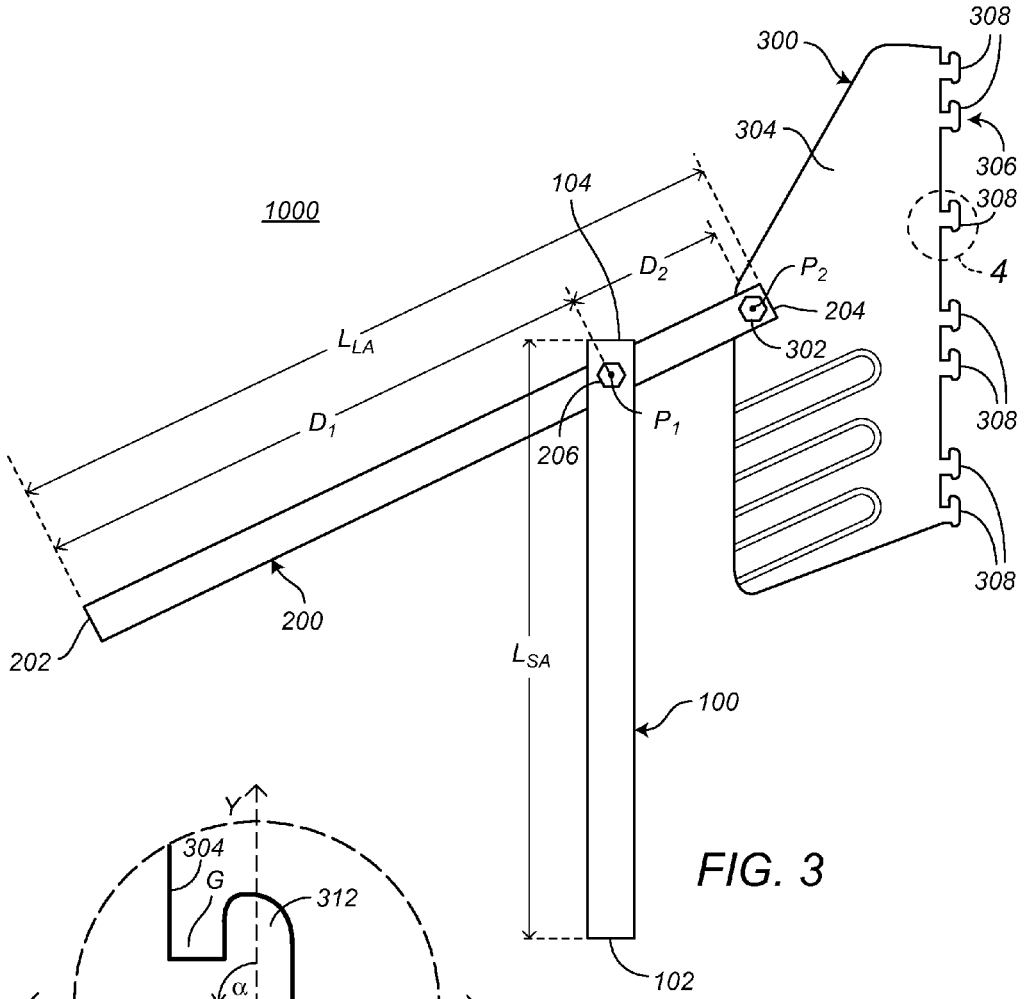
FIG. 3 is a side, elevational view of the apparatus seen in FIG. 1, according to an exemplary embodiment.

With reference to FIGS. 1-3, an apparatus 1000 is disclosed for use in lifting and moving an article 10. Although the article 10 is generally illustrated and described as office furniture, e.g., a cubicle, throughout the present disclosure, it should be understood that the apparatus 1000 may be utilized to lift and move various types of furniture, as well as other articles.

The apparatus 1000 may include, e.g., be formed from, any material suitable for use in connection with lifting and moving articles, e.g., metallic materials, such as steel, aluminum, titanium, etc., plastics, polymers, PVC, wood, and combinations thereof.

The apparatus 1000 includes a support arm 100, a lever arm 200, and a headpiece 300. The support arm 100 defines a length $L_{SA}$ which may be either fixed, as illustrated in FIGS. 1-3, e.g., 12" in one embodiment, or variable. For example to facilitate variations in the length $L_{SA}$ of the support arm 100, the support arm 100 may include one or more telescopic portions (not shown). The support arm 100 includes a first end 102 that is configured, dimensioned, and adapted to support the apparatus 1000 on a surface, e.g., the floor, as well as a second (opposite) end 104. As illustrated in FIGS. 1-3, in one embodiment of the apparatus 1000, it is envisioned that the first end 102 of the support arm 100 may directly engage the surface supporting the apparatus 1000. The support arm 100 further includes an opening 106 (FIG. 2), e.g., a channel, notch, or other such aperture, that is configured and dimensioned to receive the lever arm 200, as will be discussed in further detail below. In one embodiment, for example, the support arm 100 may be formed from 1¼"×1¼" square tubing, and the opening 106 is ¾" (W)× 2¾" (H).

The lever arm 200 includes respective first and second ends 202, 204, and defines a length $L_{LA}$ (FIG. 3) which may be either fixed, as illustrated in FIGS. 1-3, e.g., 14⅞" in one embodiment, or variable. For example to facilitate variations in the length $L_{LA}$ of the lever arm 200, the lever arm 200 may include one or more telescopic portions (not shown). In one embodiment, for example, the lever arm 200 may be formed from ¾"×¾" square tubing.

The lever arm 200 is configured and dimensioned for positioning within the opening 106 formed in the support arm 100, as seen in FIG. 2. More specifically, the lever arm 200 resides within the opening 106, and is pivotably connected to the support arm 100 at a pivot point $P_1$. For example, in the embodiment of the apparatus 1000 illustrated in FIGS. 1-3, the apparatus 1000 includes a pivot pin 206 that extends through the support arm 100 and the lever arm 200. Although illustrated as a bolt, the pivot pin 206 may be any structure suitable for the intended purpose of facilitating pivotal movement between the support arm 100 and the lever arm 200, e.g., the pivot pin 206 may include a clevis bolt and cotter pin (⅜" in one embodiment) to facilitate assembly and disassembly of the support arm 100 and the lever arm 200 without the use of tools.

The pivot point $P_1$ is spaced a first distance $D_1$ (FIG. 3) from the first end 202 of the lever arm 200, e.g., 14¼", and a second distance $D_2$ from the second end 204 of the lever arm 200, e.g., 3". In the embodiment of the apparatus 1000 illustrated in FIGS. 1-3, the support arm 100 and the lever arm 200 are configured and dimensioned such that the distance $D_1$ is equal to 25%-75% of the length $L_{LA}$ of the lever arm 200, and the distance $D_2$ is equal to 25%-75% of the length $L_{LA}$ of the lever arm 200. In alternate embodiments of the apparatus 1000, however, the position of the pivot point $P_1$ may be altered to vary the mechanical advantage created by the apparatus 1000.

With continued reference to FIGS. 1-3, the headpiece 300 will be discussed. The headpiece 300 is supported by the lever arm 200, e.g., adjacent the second end 204 thereof. More specifically, the headpiece 300 is supported within an opening 208 (FIG. 2), e.g., a channel, notch, or other such aperture, formed in the lever arm 200. For example, in one embodiment, the opening 208 is 5/16" (W)×1¼" (H).

The headpiece 300 is pivotably connected to the lever arm 200 at a pivot point $P_2$. For example, in the embodiment of the apparatus 1000 illustrated in FIGS. 1-3, the apparatus 1000 includes a pivot pin 302 that extends through the lever arm 200 and the headpiece 300, which allows the headpiece 300 to pivot (or rotate) in relation to the lever arm 200 in the directions indicated by arrows 3 and 4 in FIG. 2. Although illustrated as a bolt, the pivot pin 302 may be any structure suitable for the intended purpose of facilitating pivotal movement between the lever arm 200 and the headpiece 300, e.g., the pivot pin 302 may include a clevis bolt and cotter pin to facilitate assembly and disassembly of the lever arm 200 and the headpiece 300 without the use of tools.

In one embodiment, such as that illustrated in FIGS. 1-3, for example, the pivot points $P_1$, $P_2$ may be arranged in axial alignment, i.e., such that the pivot points $P_1$, $P_2$ lie along the same axis. In alternate embodiments, however, the pivot points $P_1$, $P_2$ may be arranged out of axial alignment.

The headpiece 300 is configured and dimensioned to engage the article 10 (FIG. 1) such that a force applied to the lever arm 200 is transmitted to the article 10 to thereby lift the article 10, as will be discussed in further detail below. To facilitate engagement of the headpiece 300 and the article 10, the headpiece 300 includes a body 304, and an engagement portion 306 that extends outwardly from the 10+body 304. In alternate embodiments of the present disclosure, the size and/or configuration of the headpiece 300 may be varied, e.g., the overall size of the headpiece 300 may be reduced, so as to increase the versatility and adaptability of the apparatus 1000 to facilitate use a variety of different articles 10 (FIG. 1), e.g., articles 10 provided by different manufacturers.

Figure 5:
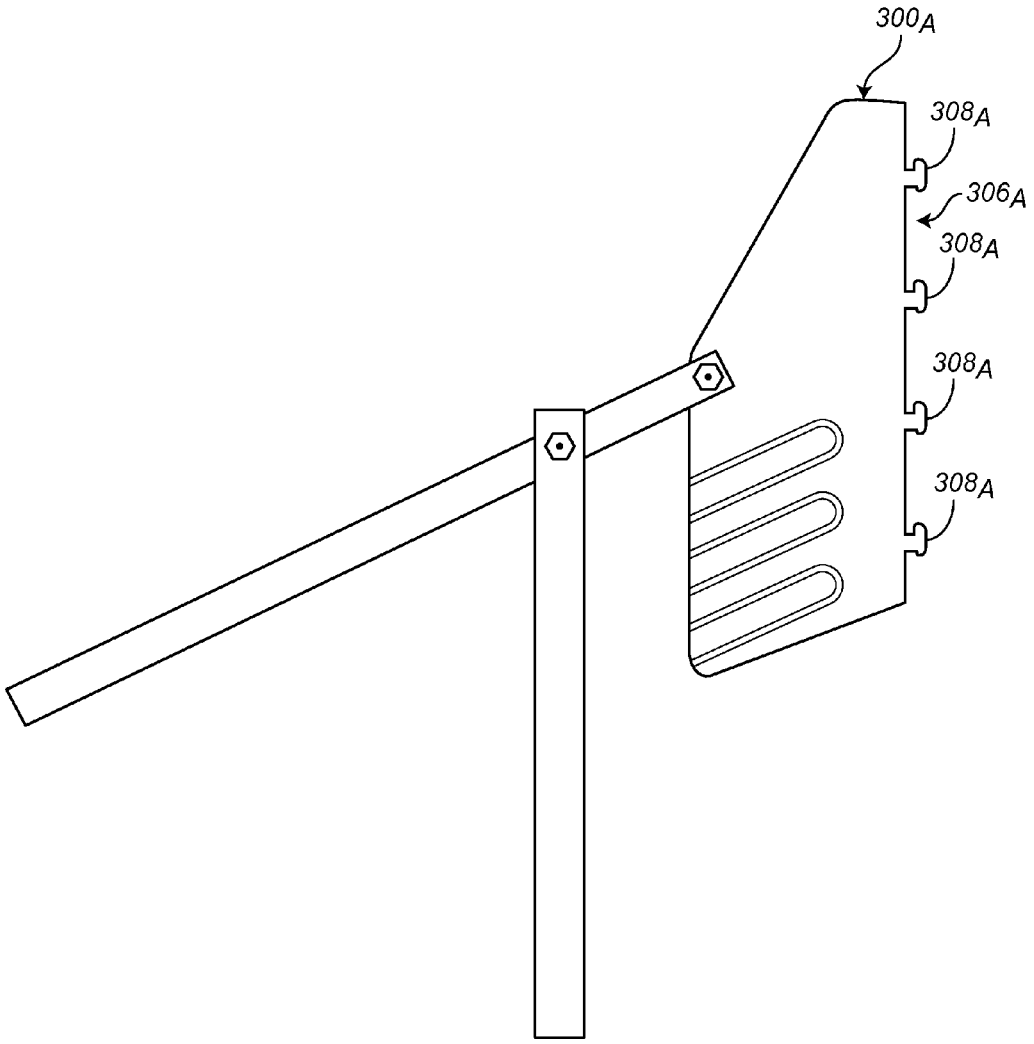
FIG. 5 is a side, elevational view of an alternate embodiment of the apparatus seen in FIG. 1.

In the embodiment of the apparatus 1000 illustrated in FIGS. 1-3, the engagement portion 306 of the headpiece 300 is configured and dimensioned for engagement with a corresponding engagement portion 12 (FIG. 1) formed in the article 10. Specifically, in the illustrated embodiment, the engagement portion 306 includes a series of male projections 308 that are configured and dimensioned for positioning within corresponding female recesses 14 (FIG. 1) formed in the article 10. Although illustrated as including seven (7) projections 308 FIGS. 1-3, in alternate embodiments of the disclosure, the projections 308 may be present in either greater or fewer numbers, and in alternate locations. For example, the engagement portion 306 may include a single projection 308, or in one particular alternate embodiment, illustrated in FIG. 5, a headpiece $\mathbf{300}_A$ is disclosed, e.g., 4¾" (H)×3" (W), including an engagement portion $\mathbf{306}_A$ having four (4) projections $\mathbf{308}_A$ positioned as shown, e.g., spaced apart by 1". Dependent upon the particular configuration and dimensions of the engagement portion 12 (FIG. 1) formed in the article 10, each of the projections 308 may be identical in configuration, as illustrated in FIGS. 1-3, for example, or may vary in configuration.

Figure 4:
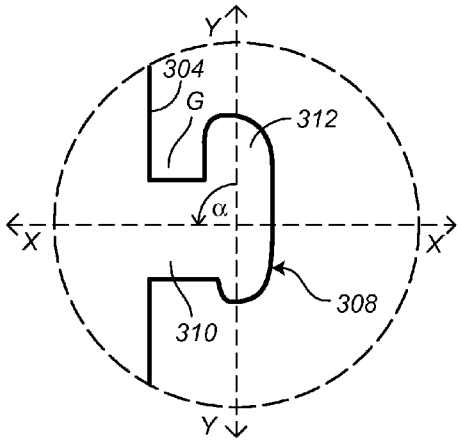
FIG. 4 is an enlargement of the area of detail indicated in FIG. 3.

With momentary reference to FIG. 4, each of the projections 308 includes a first portion 310 that extends outwardly (horizontally) from the body 304 of the headpiece 300, and a second portion 312 that extends outwardly (vertically) from the first portion 310. As illustrated in FIG. 4, the second portion 312 of the projection 308 and the body 304 of the headpiece define a gap G therebetween that is configured and dimensioned to receive a portion of the article 10.

The first portion 310 of each projection 308 extends along a first axis X, and the second portion 312 of each projection 308 extends along a second axis Y that is transverse in relation to the first axis X such that the axes X, Y subtend an angle $\alpha$. Although illustrated as being arranged in approximately orthogonal relation in the embodiment illustrated in FIG. 4, i.e., such that the angle $\alpha$ is within the range of 75°-105°, in alternate embodiments of the present disclosure, the projections 308 may be configured such that portions 310, 312 extend along axes X, Y subtending any suitable angle to increase utility of the apparatus 1000, and applicability in connection with lifting and/or moving articles having various configurations and dimensions.

With reference again to FIGS. 1-3, use of the apparatus 1000 to lift the article 10 will be discussed. Initially, the support arm 100 is stabilized on the surface supporting the apparatus 1000, e.g., the floor, and the headpiece 300 of the apparatus 1000 is positioned in engagement with the article 10 (FIG. 1), e.g., via insertion of the projection(s) 308 within the recess(es) 14. Upon positioning of the projection(s) 308 within the recess(es) 14, it is envisioned that the second portion 312 of each projection 308 may be positioned entirely within a recess 14, whereas the first portion 310 of each projection 308 may only be partially positioned with a recess 14.

After engagement of the headpiece 300 with the article 10, a force can be applied to the lever arm 200 in the direction indicated by arrow 1 (FIG. 2), which is transmitted to the article 10 and applied in the (opposite) direction indicated by arrow 2 via connection with the support arm 100 at the pivot point $P_1$ to elevate the article 10 with respect to the surface. As seen in FIG. 2, during elevation of the article 10, the headpiece 300 pivots in relation to the lever arm 200 about the pivot point $P_2$ in the direction indicated by arrow 3.

To facilitate that application of force to the lever arm 200, the lever arm 200 may include a handle, grip, or the like (not shown), which may include a molded or cushioned material in certain embodiments to increase user comfort during use of the apparatus 1000.

After elevation of the article 10, a roller, slider, or the like (not shown) can be positioned beneath the article 10 to facilitate movement of the article 10 across the surface, e.g., the floor, and the article 10 can be lowered by reducing the force applied to the lever arm 200. As the force applied to the lever arm 200 is reduced, and the article 10 is lowered, the headpiece 300 pivots in relation to the lever arm 200 about the pivot point $P_2$ in the direction indicated by arrow 4. After lowering of the article 10, the apparatus 1000 can be disengaged from the article 10, e.g., by removing the projection(s) 308 from the recesses 14 (FIG. 1).

With reference now to FIGS. 6-11, alternate embodiments of the apparatus 1000 will be discussed. The various embodiments discussed below are identical to the apparatus 1000 but for any distinctions that are specifically noted. Accordingly, a discussion of certain features common to the apparatus 1000 and the various embodiments discussed below may be omitted in the interest of brevity.

Figure 6:
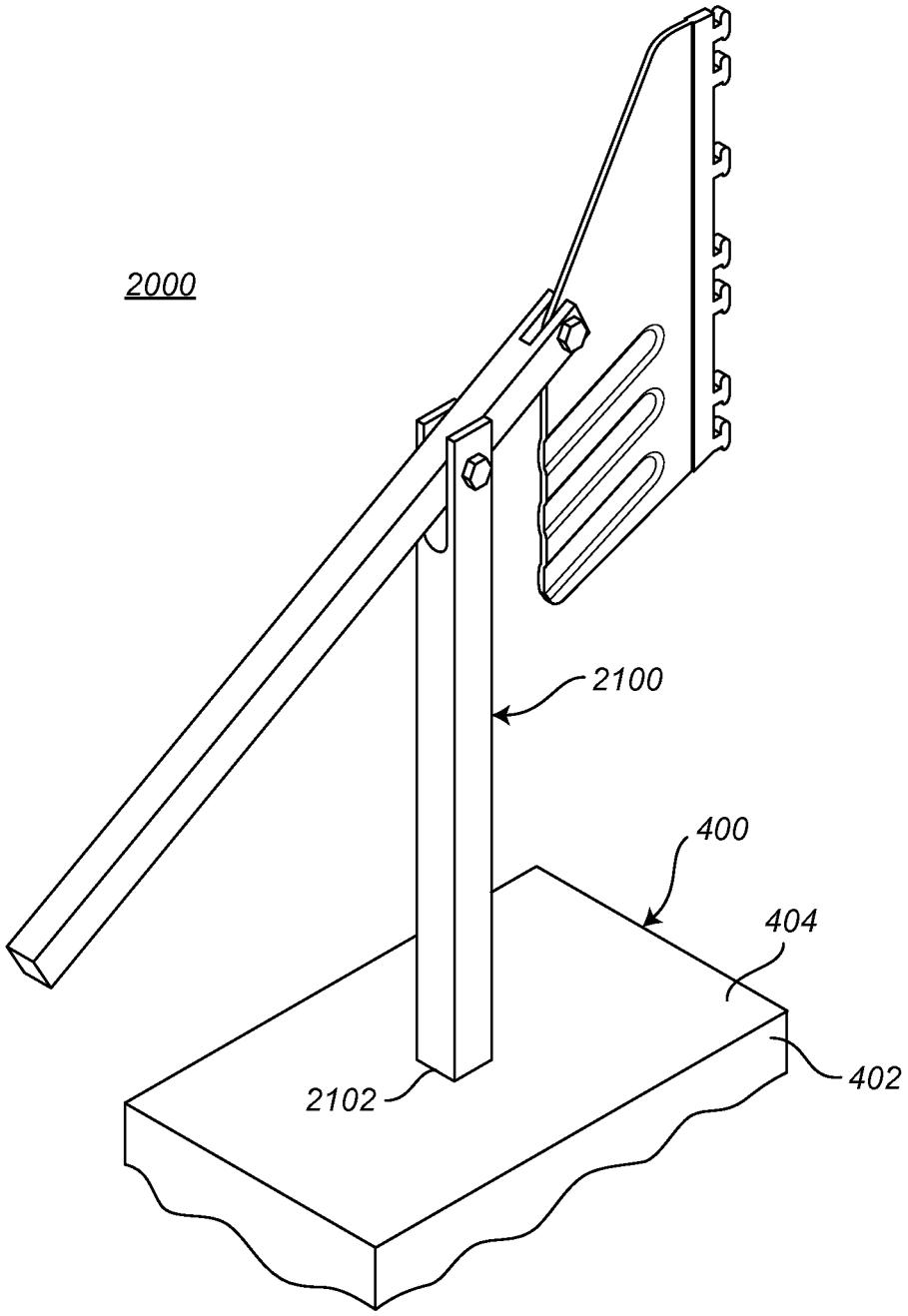
FIG. 6 is a side, perspective view of an alternate embodiment of the apparatus seen in FIG. 1 including a footing.

FIG. 6 illustrates an embodiment of the presently disclosed apparatus, identified by the reference character 2000, that includes a footing 400 located adjacent the end 2102 of the support arm 2100. The footing 400 is configured and dimensioned to increase stability of the apparatus 2000 by increasing the surface area of the apparatus 2000 in contact with the surface on which the apparatus 2000 is supported, e.g., the floor. In one embodiment, for example, the footing 400 be ¼" (H)×2" (W)×2" (D). Although the footing 400 is illustrated as being generally square in the embodiment of the apparatus 2000 depicted in FIG. 6, in alternate embodiments of the disclosure, the configuration and dimensions of the footing 400 may be altered or varied without departing from the scope of the present disclosure.

In certain embodiments, such as that illustrated in FIG. 6, the footing 400 may include a surface interface 402 secured to an underside thereof to minimize any negative impact on the surface on which the apparatus 2000 is supported, e.g., scratching, indentations, etc. For example, it is envisioned that a body 404 of the footing 400 may include, e.g., be formed from, a first material having a first durometer, such as steel, whereas the surface interface 402 may include, e.g., be formed from, a second material having a second, lower durometer, such as rubber.

During use of the apparatus 2000, upon the application of a force to the lever arm 2200, dependent upon the magnitude of the force, and the materials used in construction of the footing 400, the surface interface 402 may be compressed against the surface to thereby absorb a portion of the force.

Figure 7:
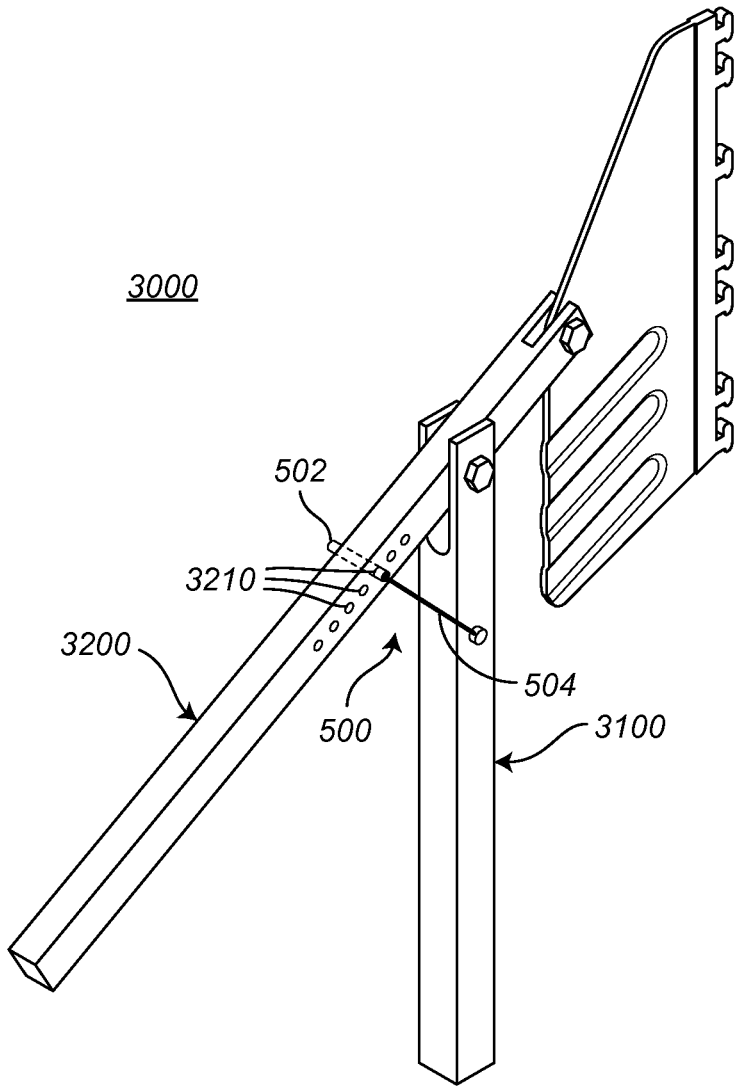
FIG. 7 is a side, perspective view of an alternate embodiment of the apparatus seen in FIG. 1 including a locking mechanism.

With reference now to FIG. 7, another embodiment of the apparatus, identified by the reference character 3000, will be discussed. The apparatus 3000 includes a locking mechanism 500 that is selectively actuable to secure and maintain the position of the lever arm 3200 in relation to the support arm 3100, e.g., following elevation of the article 10 (FIG. 1). For example, as illustrated in FIG. 7, in one embodiment, the locking mechanism 500 may include a pin 502 secured to the support arm 3100 by a tether 504 that is configured and dimensioned for insertion into an opening 3210 formed in the lever arm 3200. Alternatively, the locking mechanism 500 may be configured as a bracket, or any other mechanism suitable for the intended purpose of securing and maintaining the position of the lever arm 3200 in relation to the support arm 3100.

During use of the apparatus 3000, after the article 10 (FIG. 1) has been elevated, the locking mechanism 500 can be actuated, e.g., via insertion of the pin 502 into the opening 5210 formed in the lever arm 3200. With the apparatus 3000 locked, the user is free to release the lever arm 3200, and position the aforementioned roller, slider, or the like (not shown) beneath the article 10, or complete another task, thereby reducing, if not completely obviating, the need for assistance.

Figure 8:
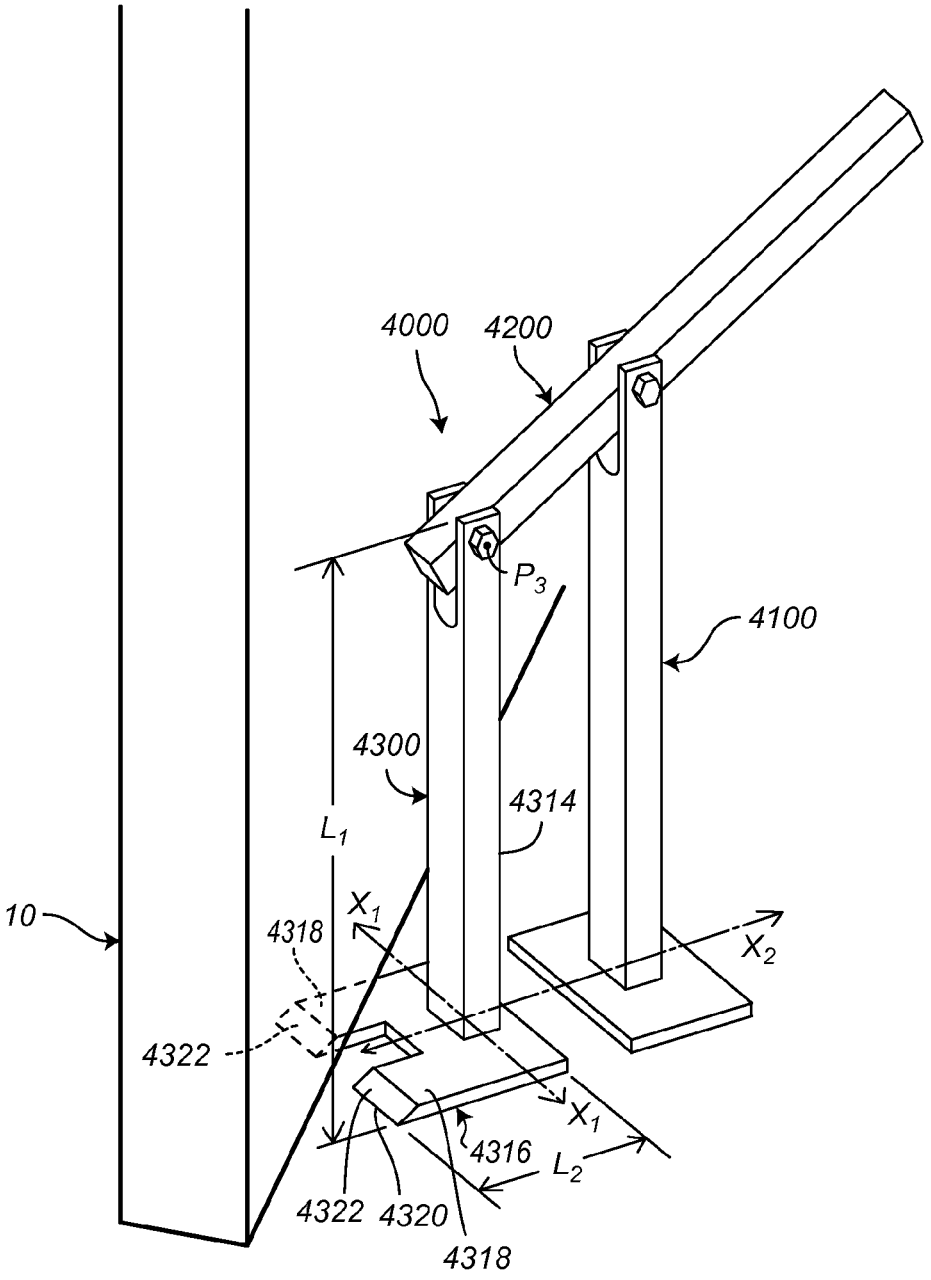
FIG. 8 is a side, perspective view illustrating an article, e.g., office furniture, together with another embodiment of the presently disclosed apparatus.

With reference now to FIG. 8, another embodiment of the apparatus, identified by the reference character 4000, will be discussed. The apparatus 4000 includes a headpiece 4300 that is generally L-shaped in configuration. More specifically, the headpiece 4300 includes a first leg 4314, e.g., formed from 1¼"×1¼" flat stock, that is connected to the lever arm 4200 at pivot point $P_3$, e.g., spaced ⅝" from the end of the first leg 4314, and a second leg 4316 that is connected to, and extends from, the first leg 4314. In one embodiment, for example, the first leg 4314 is 10⅛" in height, and the second leg 4316 is 4¼" (L)×3" (W).

In the embodiment illustrated in FIG. 8, the legs 4314, 4316 are depicted as extending along axes $X_1$, $X_2$, respectively, that are approximately orthogonal in relation to each other, e.g., at an angle of 75°-105°. In alternate embodiments of the disclosure, however, the configuration and orientation of the legs 4314, 4316 may be varied to increase utility of the apparatus 4000, and applicability in connection with lifting and/or moving articles having various configurations and dimensions. For example, the legs 4314, 4316 may be arranged such that they extend along axes subtending any suitable acute or obtuse angle.

The first leg 4314 defines a first length $L_1$, e.g., 10⅛" in one embodiment, and the second leg 4316 defines a second length $L_2$, e.g., 4¼" in one embodiment, and a width, e.g., 3". In certain embodiments, such as that illustrated in FIG. 8, for example, the length $L_2$ of the second leg 4316 may be less than the length $L_1$ of the first leg 4314. In alternate embodiments, however, the legs 4314, 4316 may be configured and dimensioned such that the lengths $L_1$, $L_2$ are equivalent, or such that the length $L_2$ of the second leg 4316 is greater than the length $L_1$ of the first leg 4314.

Figure 9:
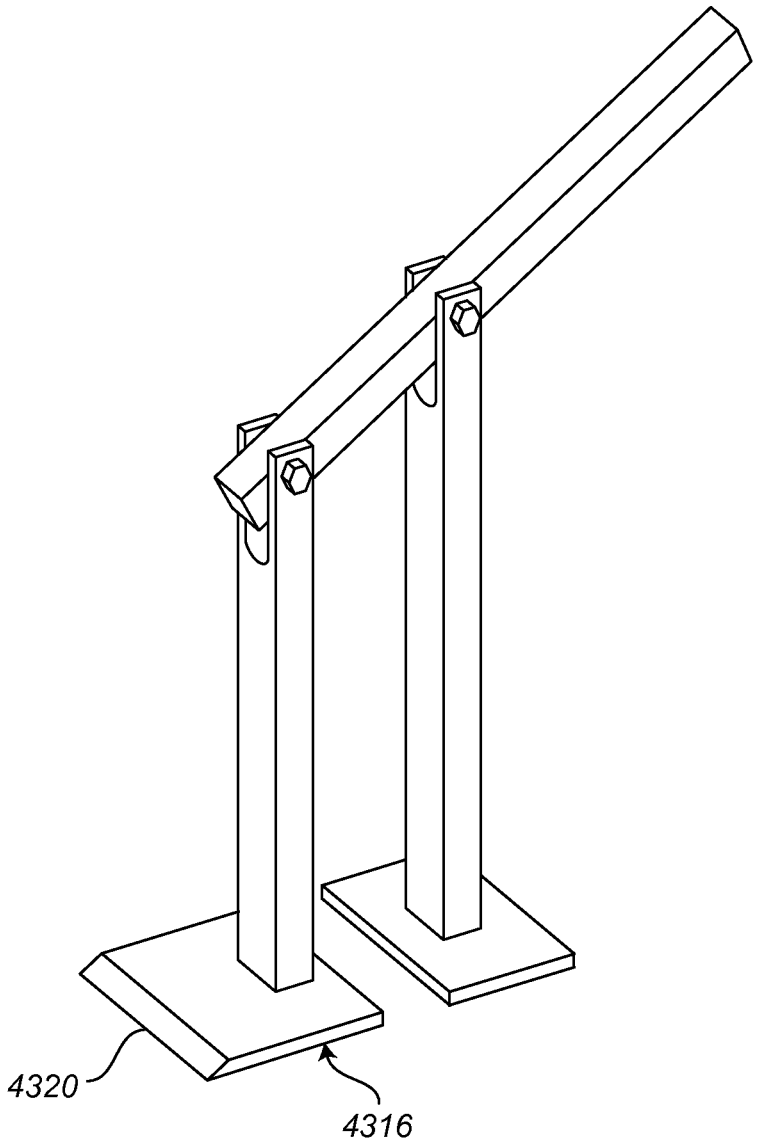
FIG. 9 is a side, perspective view illustrating another embodiment of the presently disclosed apparatus.

In one embodiment, it is envisioned that the second leg 4316 may include a plurality of discrete fingers 4318, as illustrated in FIG. 8, such that the second leg 4316 defines a discontinuous edge 4320, and the second leg 4316 includes a groove between the fingers 4318, e.g., 1"×1½" in one embodiment. Although illustrated as including a pair of fingers 4318, the number of fingers 4318 may be increased in alternate embodiments of the present disclosure, e.g., dependent upon the nature and physical characteristics of the article 10 to be moved. Alternatively, the second leg 4316 may be configured so as to be devoid of the fingers 4318, or any other projections, etc., i.e., such that the edge 4320 is continuous, as illustrated in FIG. 9.

During use of the apparatus 4000, the headpiece 4300 is positioned in engagement with the article 10, e.g., such that the second leg 4316 is positioned beneath the article 10, and the support arm 4100 is stabilized on the surface supporting the apparatus 4000, e.g., the floor. To facilitate positioning of the headpiece 4300 beneath the article 10, the second leg 4316 may include a bevel 4322, as seen in FIG. 9.

After positioning the second leg 4316 beneath the article 10, a force is applied to the lever arm 4200 such that the article 10 is elevated in the manner discussed above.

Subsequently, the article 10 can be lowered onto a roller, slider, or the like (not shown) for relocation, and the apparatus 4000 can be disengaged from the article 10.

Figure 10:
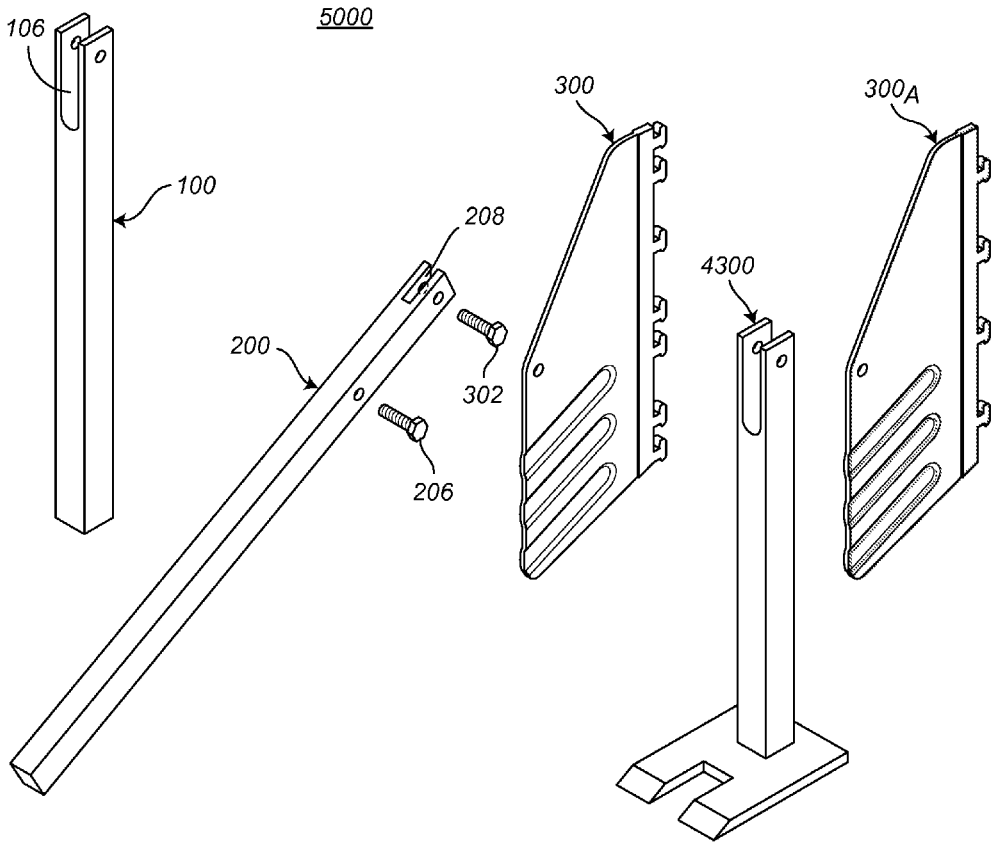
FIG. 10 is a perspective view of a kit for use in elevating an article, e.g., office furniture, according to an exemplary embodiment of the present disclosure.

With reference now to FIG. 10, a kit 5000 is illustrated for use in lifting the article 10 (FIG. 1). The kit 5000 includes the support arm 100, the lever arm 200, the headpiece 300, and the pivot pins 206, 302 discussed above with respect to FIGS. 1-3, the headpiece $\mathbf{300}_A$ discussed above with respect to FIG. 5, and the headpiece 4300 discussed above with respect to FIG. 8. By providing the kit 5000 with various headpieces, e.g., headpieces 300, 4300, the versatility and adaptability of the kit 5000 can be increased to facilitate use a variety of different articles 10 (FIG. 1) having various configurations and dimensions.

During use of the kit 5000, the article 10 (FIG. 1) is initially inspected such that the appropriate headpiece, e.g., headpiece 300 or headpiece 4300, can be selected for use. Thereafter, the support arm 100 and the lever arm 200 are assembled by positioning the lever arm 200 within the opening 106 (FIG. 2) formed in the support arm 100, and passing the pivot pin 206 through the arms 100, 200. The selected headpiece, e.g., the headpiece 300, and the lever arm 200 are then assembled by positioning the headpiece 300 within the opening 208 (FIG. 2) formed in the lever arm 200, and passing the pivot pin 302 through the lever arm 200 and the headpiece 300 to form the apparatus, i.e., the apparatus 1000 (FIGS. 1-3) in the instant embodiment.

After assembly, the apparatus 100 can be used to elevate the article 10 in the manner discussed above.

Figure 11:
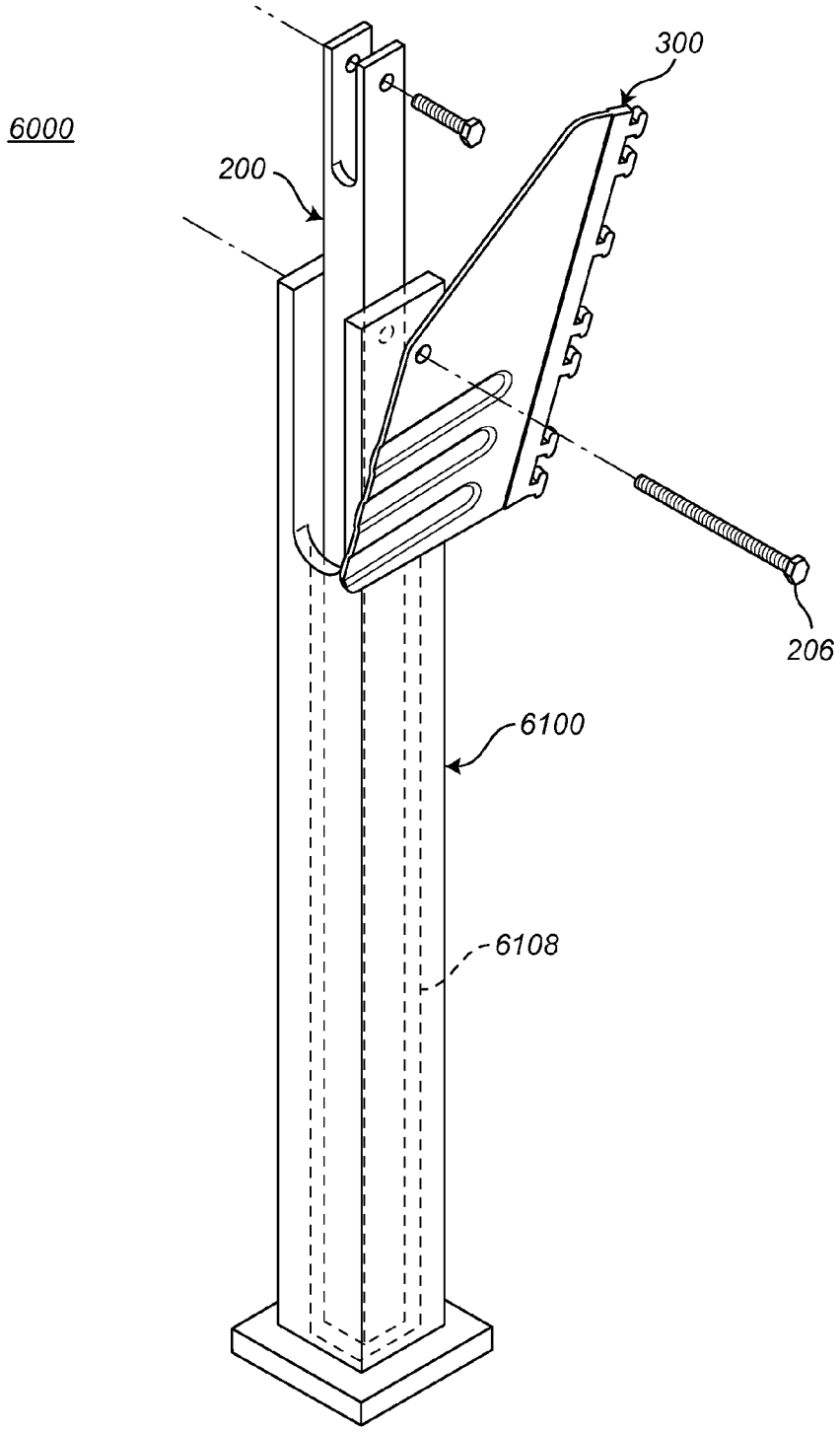
FIG. 11 is a side, perspective view illustrating another embodiment of the presently disclosed apparatus.

FIG. 11 illustrates an embodiment of the presently disclosed apparatus, identified by the reference character 6000. The apparatus 6000 includes a support arm 6100 defining an internal cavity 6108, e.g., a channel, chamber, or other such opening, that is configured and dimensioned to removably receive the lever arm 200 such that the apparatus 6000 is nestable upon disassembly to reduce the amount of space occupied by the apparatus 6000 during non-use, e.g., during shipping, etc. Although illustrated as including the headpiece 300 in the embodiment shown in FIG. 11, it should be appreciated that the apparatus 6000 may include any of the headpieces described herein, e.g., the headpiece 4300 (FIG. 8). To further reduce the amount of space required for storage of the apparatus 6000 during non-use, the headpiece, e.g., the headpiece 300, may be detached from the lever arm 200 and secured to the support arm 6100 using the pivot pin 206, for example.

While the present disclosure has been described in connection with specific, illustrative embodiments, it should be understood that the subject matter of the present disclosure is capable of further modifications. For example, persons skilled in the art will understand that additional components and features may be added to any of the embodiments discussed herein above, and that those elements and features described in connection with any one embodiment may also be applicable to, or combined with, those of any other embodiment without departing from the scope of the present disclosure.

The scope of the present disclosure is intended to cover any variations, uses, and/or adaptations of the presently disclosed subject matter in accordance with the principles of the present disclosure, including such departures from the present disclosure that come within known or customary practice within the art to which the present disclosure pertains.

What is claimed is:

1. A kit for use in lifting an article, the kit comprising:

a support arm including a first channel notch configured and dimensioned to receive a lever arm;

the lever arm connectable to the support arm at a first pivot point in the first channel notch using a first pivot pin such that the lever arm is pivotally movable in relation to the support arm, wherein the lever arm includes a second channel notch configured and dimensioned to receive at least one of a first headpiece and a second headpiece at a second pivot point, wherein a second pivot pin extends through the lever arm and the headpiece at the second pivot point of the second channel notch;

the first headpiece connectable to the lever arm only at the second pivot point, the first headpiece having a first configuration having a plurality of male engagement portions extending along an edge of the first headpiece facilitating engagement with the article, wherein a first male engagement portion along the edge is above the second pivot point and a last male engagement portion along the edge is below the second pivot point; and the second headpiece connectable to the lever arm only at the second pivot point, the second headpiece having a second configuration having a plurality of male engagement portions extending along an edge of the second headpiece facilitating engagement with the article, wherein a first male engagement portion along the edge is above the second pivot point and a last male engagement portion along the edge is below the second pivot point, the second configuration being different than the first configuration.

2. The kit of claim 1, wherein the first headpiece includes a male engagement portion configured and dimensioned for engagement with a female engagement portion of the article, the male engagement portion of the first headpiece having a first configuration, the second headpiece including a male engagement portion configured and dimensioned for engagement with the female engagement portion of the article, the male engagement portion of the second headpiece having a second configuration different than the first configuration.

3. The kit of claim 2, wherein the male engagement portion of the first headpiece includes a body, and at least one projection extending outwardly from the body configured and dimensioned for positioning within at least one recess defined by the female engagement portion of the article.

4. The kit of claim 3, wherein the at least one projection includes a plurality of projections.

5. The kit of claim 3, wherein the at least one projection includes a first portion extending outwardly from the body of the first headpiece along a first axis, and a second portion extending outwardly from the first portion along a second axis transverse in relation to the first axis, the body of the first headpiece and the second portion of the at least one projection defining a gap therebetween configured and dimensioned to receive a portion of the article.

6. The kit of claim 5, wherein the at least one projection is configured and dimensioned such that the first and second axes subtend an angle of 90°.

7. The kit of claim 5, wherein the at least one projection is configured and dimensioned such that the first and second axes subtend an angle less than 90°.

8. The kit of claim 5, wherein the at least one projection is configured and dimensioned such that the first and second axes subtend an angle greater than 90°.

9. The kit of claim 1, wherein the first pivot point and a first end of the lever arm define a first distance therebetween, and the first pivot point and a second, opposite end of the lever arm define a second distance therebetween less than the first distance.

10. The kit of claim 9, wherein the first distance is 25%-75% of an overall length of the lever arm.

11. The kit of claim 1, wherein the first and second pivot points are in axial alignment.

12. The kit of claim 10, wherein the support arm includes a footing.

13. The kit of claim 12, wherein the footing includes a body, and a surface interface secured to the body, the body of the footing including a first material having a first durometer, and the surface interface including a second material having a second durometer lower than the first durometer.

14. The kit of claim 1, wherein the second headpiece is generally L-shaped in configuration, the second headpiece including a first leg connectable to the lever arm and extending along a first axis, and a second leg connected to and extending from the first leg along a second axis transverse in relation to the first axis.

15. The kit of claim 14, wherein the first and second axes subtend an angle of approximately 90°.

16. The kit of claim 14, wherein the second leg includes a plurality of discrete fingers.

17. The kit of claim 14, wherein the second leg includes a beveled edge to facilitate positioning of the second leg beneath the article.

18. The kit of claim 14, wherein the first leg defines a first length, and the second leg defines a second length, the second length being less than the first length.

* * * * *